United States Patent [19]

Ebey

[11] Patent Number: 4,866,456

[45] Date of Patent: Sep. 12, 1989

[54] HORIZON-TO-HORIZON SATELLITE ANTENNA DRIVE MECHANISM

[75] Inventor: Edward W. Ebey, Nashotah, Wis.

[73] Assignee: Fulton Manufacturing Corporation, Milwaukee, Wis.

[21] Appl. No.: 886,022

[22] Filed: Jul. 16, 1986

[51] Int. Cl.[4] ..... H01Q 3/00

[52] U.S. Cl. ..... 343/766; 343/763; 343/757; 343/758; 343/765

[58] Field of Search ..... 343/766, 763, 757, 758, 343/765

[56] References Cited

U.S. PATENT DOCUMENTS

| | | | |
|---|---|---|---|
| 2,570,197 | 6/1951 | Bohnert et al. | 343/761 |
| 2,617,029 | 11/1952 | Plummer et al. | 343/761 |
| 2,759,182 | 3/1956 | Chaffee | 343/757 |
| 2,924,824 | 2/1960 | Lanctot et al. . | |
| 3,040,318 | 6/1962 | Lang et al. . | |
| 3,041,609 | 6/1962 | Rathenau . | |
| 3,233,475 | 2/1966 | Barber . | |
| 3,439,550 | 3/1967 | Goulding | 343/765 |
| 3,546,704 | 12/1970 | Selby et al. . | |
| 3,886,559 | 5/1978 | Lanson et al. . | |
| 3,893,123 | 7/1975 | Bieser . | |
| 3,987,452 | 10/1976 | Godet . | |
| 4,238,802 | 12/1980 | Speicher | 343/765 |

OTHER PUBLICATIONS

Satellite Antenna UST-110, Uniden Corporation of America Continental Parabolic Perfection, Continental Satellite Systems Channel Master Satellite Reception Equipment, Channel Master.

*Primary Examiner*—William L. Sikes
*Assistant Examiner*—Hoanganh Le
*Attorney, Agent, or Firm*—Edgar A. Zarins; Malcolm L. Sutherland

[57] ABSTRACT

A satellite antenna drive mechanism which includes a drive gear housing for reciprocally driving a satellite antenna dish. Generally, the satellite dish is supplied with a retaining bracket to which a U-shaped bow screw is mounted. The bow screw threadably engages the drive gear housing such that rotation of the drive gears causes a corresponding movement of the bow screw and the dish. The drive housing includes three meshed gears which cooperate to drive the bow screw. A first gear drive is connected to drive means for manually or mechanically driving the gears. An intermediate gear connects the first gear to a third internally threaded gear which receives the bow screw of the antenna dish. This third gear drive is positionally captured between the wall plates of the housing yet is free floating within the housing to provide smooth travel of the bow screw through the drive housing.

16 Claims, 2 Drawing Sheets

HORIZON-TO-HORIZON SATELLITE ANTENNA DRIVE MECHANISM

BACKGROUND OF THE INVENTION

1. Field of the Invention

This invention relates to antenna drive mechanisms and, in particular, to a drive mechanism for a satellite antenna dish which utilizes a free-floating output gear within a gear housing to reciprocally vary the directional position of the satellite dish.

2. Description of the Prior Art

Satellite dish antennas have become widely used in recent years to receive communications, particularly video signals, from satellites orbiting the earth. Generally, these antennas, or earth stations, collect microwave signals broadcast by communications satellites orbiting above the equator. The satellites orbit at the same speed the earth rotates so that their positions remain fixed along a similar orbit, which allows broadcasters to use them as relay stations for their programming. Since a plurality of these satellites appear to lie in an arc extending from one horizon to the other, a satellite antenna should be capable of being directionally positioned along this horizon-to-horizon arc.

Various drive means have been developed to alter the directional position of a satellite antenna dish. Although various systems have been developed in connection with tracking and research antennas to provide complete hemispherical coverage, it is generally established that drive systems associated with communication satellite antennas need only move the antenna in an arcuate path in order to provide proper reception. In addition, because modern antenna dishes are designed for individual home use, the drive system should be as simple as possible to minimize the cost and complexity of the system. However, both manual and motor driven systems are well known.

Most of the past known horizon-to-horizon drive systems for satellite antennas utilize some variation of a worm-gear drive. These systems are generally mounted directly to the support shaft of the antenna and utilize a rotatable worm to drive a gear connected to the antenna dish. Variations of this system include the use of a gear rack or partial gears in place of the gear which controls the movement of the antenna dish. Because of the interaction between the components of these drive systems, the worm and gear must be kept well lubricated to minimize friction and prevent malfunction. In addition, the worm and gear drives are subject to severe backlash which causes misalignment of the antenna. Since the satellites from which the antennas receive their signals are over 20,000 miles above the equator, a 1° misalignment of the antenna can cause a disruption or interruption of the communication signal. Once backlash between the intermeshing components of the system causes misalignment, a service technician must readjust the antenna in order to provide accurate directional alignment of the system.

In order to reduce jamming and backlash between the cooperating components of known drive systems, a drive system has been developed which utilizes a threaded bow screw that cooperates with a gear housing. Generally, these known systems utilize a bow screw with a diameter of $\frac{5}{8}''$ or smaller which cooperates with an internally threaded drive gear mounted within a gear housing. The gear housing includes an input gear engagingly meshed with the internally threaded output gear. Both gears have their hubs or axles fixedly secured to the housing so that their relative positions are fixed. The bow screw extends through and cooperates with the output gear whereby rotation of the output gear causes linear movement of the bow screw. However, because of the fixed relationship between the bow screw, the output gear, and the input gear, the load exerted by the antenna dish tends to cause jamming between the drive gears and between the output gear and the bow screw. Again, due to this jamming, backlash may occur causing misalignment of the antenna. In addition, because of the small diameter of the bow screw and the loads exerted by movement of the antenna, extensive use of the drive system will cause the bow screw to warp thereby limiting movement of the antenna to approximately 15° from its center position. Although this range of movement is adequate for most applications, as additional communication satellites are placed within the equatorial orbit, this limited range of movement will render such drive systems obsolete sine they are not capable of complete horizon-to-horizon movement.

Thus, a drive system which provides complete horizon-to-horizon movement of the antenna dish while eliminating backlash due to jamming of the interacting components is necessary in order to meet modern requirements.

SUMMARY OF THE PRESENT INVENTION

The present invention is an improved drive mechanism for a satellite antenna dish which overcomes all of the disadvantages of the previously known drive mechanisms by providing a positionally captured yet free-floating output gear.

The drive mechanism of the present invention is designed to be used with satellite antenna dishes having a retaining bracket secured to the rear face of the antenna dish. A bowed or U-shaped threaded member is secured to the retaining bracket by mounting the ends of the threaded member through holes provided in the retaining bracket such that the threaded member extends away from the satellite dish. This threaded member extends through a gear housing which includes a series of drive gears to drive the threaded member and therefore the satellite dish. The gear housing preferably includes three drive gears engagingly aligned between a pair of end plates which form the gear housing. An input pinion gear is axially connected to the drive system for the mechanism. This drive system can be either a manual drive comprising a rotatable crank connected to the axle of the input gear or a motor drive which allows remote adjustment of the antenna dish. Engagingly meshed with the input gear is an intermediate idler gear which transmits the rotational movement from the input gear to an output pinion gear which drives the threaded member. In a preferred embodiment, the idler gear is larger than both the input and output gears in order to provide efficient transmittal of the rotational inertia produced by the drive means.

The output pinion gear of the gear housing is internally threaded in order to receive the threaded member. Thus, the internal threads of the output gear drive the threaded member upon rotation of the output gear. Since the drive gears can be rotated in either direction, the threaded member can be reciprocatingly driven in order to precisely adjust the antenna dish. Although the input gear and the idler gear have their hubs fixedly secured to the end plates of the gear housing, the output gear is positionally captured by the housing such that it is free-floating within the housing limited only by the idler gear, with which it remains engaged, and the edges of the housing. This freedom of movement reduces jamming between the threaded member and the output gear and between the output gear and the other drive gears. Thus, the present invention provides a simple drive mechanism for accurately directing an antenna dish which reduces jamming and wear between components of the system.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views, and in which.

DETAILED DESCRIPTION OF A PREFERRED EMBODIMENT OF THE PRESENT INVENTION

Figure 1:
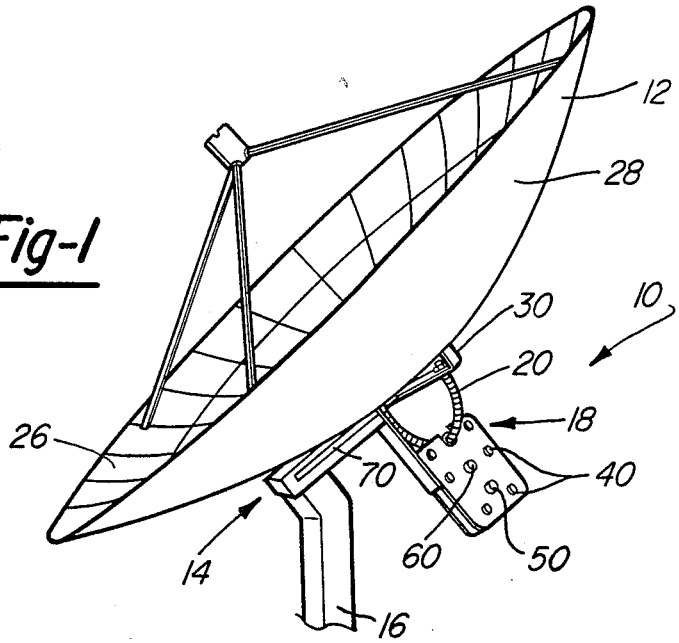
FIG. 1 is an elevated perspective of a satellite antenna dish with the drive mechanism of the present invention.

Referring generally to FIG. 1, a satellite antenna system 10 embodying the present invention is there shown comprising an antenna dish 12 and a supporting structure 14 for the dish 12. The supporting structure 14 includes an upright support 16, which supports the dish 12 on the ground or building top, and a drive mechanism 18 which allows directional adjustment of the dish 12 relative to the stationary support 16. The drive mechanism 18 generally includes a threaded drive member 20, a gear housing 22 connected to the threaded member 20, and drive means 24 for driving the mechanism 18. Although the antenna system 10 of the present invention is shown and described with a monopolar support structure 14 it is to be understood that the drive mechanism 18 of the present invention can be utilized with all types of support structures which permit horizon-to-horizon adjustment of the antenna 12.

The antenna dish 12 may be any of the known signal receiving antenna widely utilized to receive a satellite transmission and generally includes a signal receiving face 26 and a rear face 28. In the preferred embodiment of the present invention, a retaining bracket 30 is secured to the rear face 28 of the dish 12. This bracket 30 is utilized to attach the drive mechanism 18 to the antenna 12 and can be any configuration. However, the present invention will be described in conjunction with a retaining bracket 30 which is secured at both its ends to the rear face 28 of the dish 12. The retaining bracket 30 includes a pair of apertures disposed at the opposite ends of the bracket 30 and which receive the ends of the threaded member 20. The ends of the member 20 are secured into place by removable mounting nuts 32 which abut against the retaining bracket 30. Alternatively, the threaded member 20 may be permanently secured to the bracket 30 by welds or the like. However, it is preferred that the member 20 be removably secured to the bracket 30 for ease of assembly. In a still further alternative, the bracket may be eliminated whereby the ends of the threaded member 20 can be secured directly to the dish.

Figure 2:
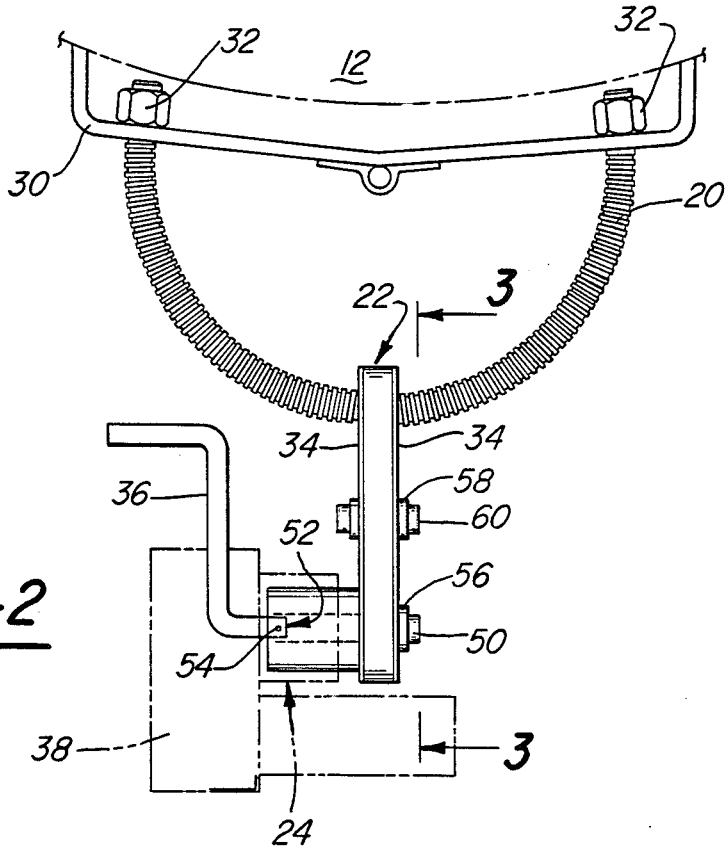
FIG. 2 is a perspective view of the drive mechanism of the present invention.

Referring now to FIG. 2, the threaded member 20 is generally U-shaped to allow travel over its full length. The threaded member 20 extends through the gear housing 22 which reciprocally drives the threaded member 20 as will be subsequently described herein. The gear housing 22 has a substantially rectangular configuration and includes opposing plate walls 34 which enclose the drive gears therein. Connected to the gear housing 22 is the means 24 for driving the gears of the gear housing 22. This drive means 24 may be either a manual drive in the form of a hand crank 36 as shown in FIG. 2, or a motor drive 38 as shown in FIG. 1 and in phantom in FIG. 2. Either drive type may be readily attached to the gear housing 22 in accordance with the user's preference. Of course, the motor drive 38 provides added convenience since control of the drive mechanism 18 may be achieved from a remote site such as from within the user's home.

Figure 3:
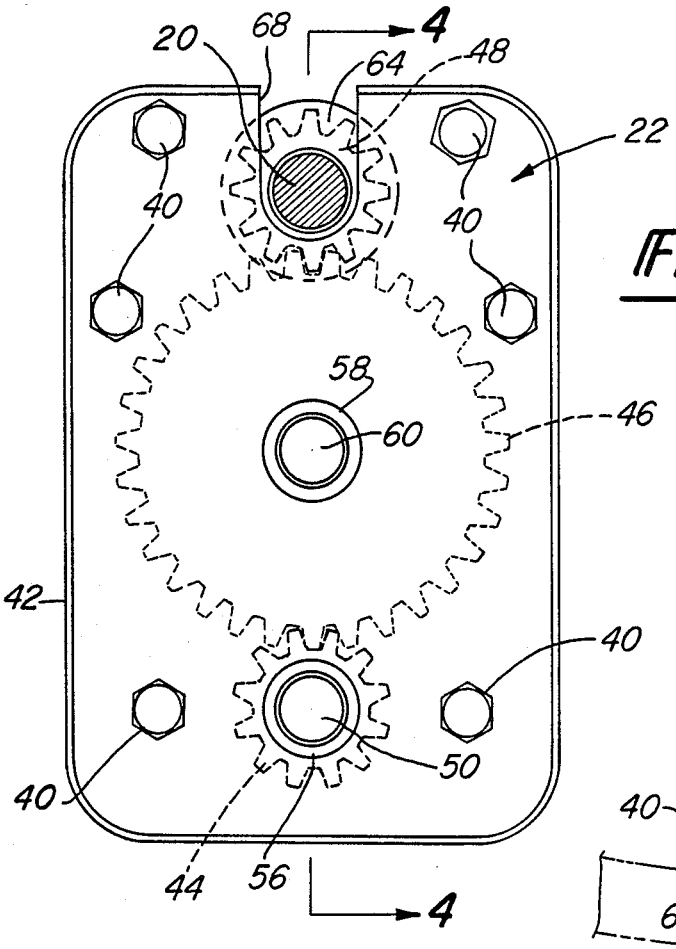
FIG. 3 is a side perspective view of the gear housing of the present invention taken along line 3—3 of FIG. 2.
Figure 4:
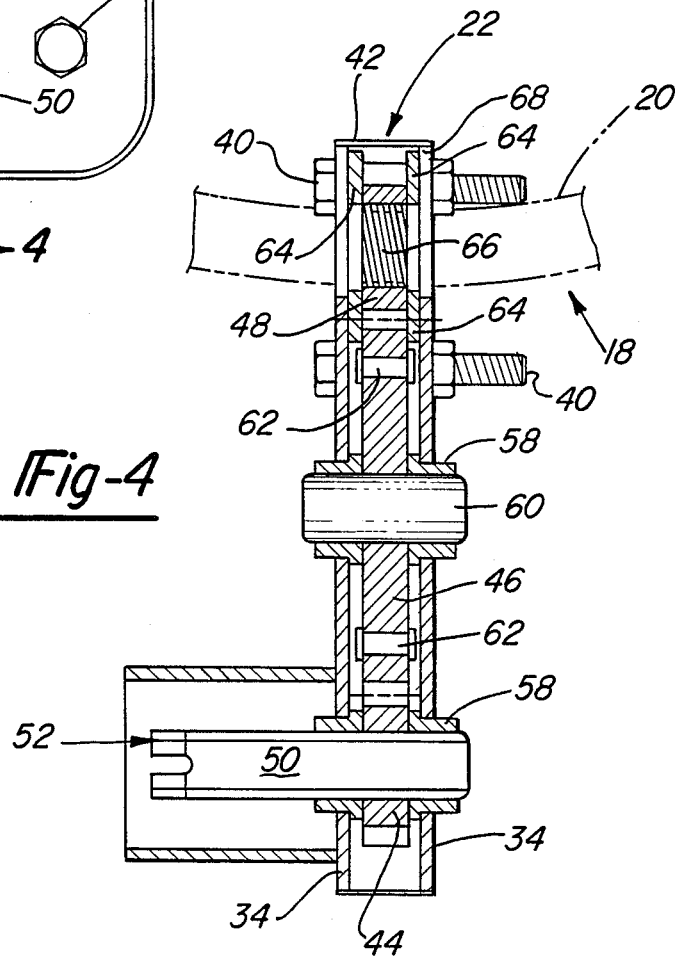
FIG. 4 is a cross-sectional view of the gear housing of the present invention taken along line 4—4 of FIG. 3.

As is best shown in FIGS. 3 and 4, the gear housing 22 is defined by the plate walls 34 which are secured by a plurality of bolts 40 extending therethrough. A peripheral wall 42 is also included in order to prevent contaminants and moisture from readily entering the housing 22. Disposed between the plates 34 of the housing 22 are a plurality of meshed gears through which the rotational movement of the drive means 24 is transferred to the threaded member 20. In the preferred embodiment, three interacting gears are disposed within the housing 22: an input pinion gear 44, an intermediate idler gear 46, and an output pinion gear 48.

The input pinion gear 44 is axially connected to the drive means 24 through the hub extension 50. Formed in the remote end of the extension 50 is a U-joint 52 which permits direct connection of the gear 44 to the drive means 24. As is shown in FIG. 2, the extension 50 is connected to the crank 36 by an engagement pin 54 extending through both components. The gear 44 is mounted within the housing 22 by the hub 56 which maintains the lateral position of the gear 44 between the plates 34.

Connected to the input gear 44 is intermediate idler gear 46 which translates the rotation from the input gear 44 to the output gear 48. In the preferred embodiment, the intermediate idler gear 46 has a greater diameter than the other two gears 44 and 48. However, the idler gear 46 may be smaller or eliminated altogether in order to reduce the size of the gear housing 22. As with input gear 44, the intermediate idler gear 46 is mounted within the housing 22 by a hub 58 which retains the axle 60 of the gear 46. In addition to providing support for the axle 60, the hub 58 also maintains the lateral position of the gear 46. However, because of the larger diameter of the idler gear 46 and the stress imparted upon the gears by the antenna 12, the idler gear 46 is provided with a plurality of bearing plugs 62 which prevent the peripheral edge of the gear 46 from contacting the housing walls 34, thereby maintaining proper alignment of the gears.

Referring still to FIGS. 3 and 4, the output pinion gear 48 is positionally captured between the plates 34 of the gear housing 22 such that the output gear 48 meshes with the idler gear 46. The output gear 48 is not mounted to the housing 22 but rather is allowed to float freely between the plates 34. Spacer plates 64 are disposed between the output pinion gear 48 and the walls 34 of the gear housing 22. These spacers 64 maintain the proper alignment of the gear 48 while allowing it to float freely therebetween. In the preferred embodiment, the spacer plates 64 are circular and closely conform to the size of the gear 48. However, the spacer plates 64 may be any shape or size which maintains proper alignment of the gear 48 between the walls 34 of the housing 22.

As shown in FIG. 4, the output gear 48 has internal threads 66 in order to threadably engage the threaded member 20. Thus, rotation of the gear 48 will cause the threaded member 20 to travel through the gear housing 22 accordingly. A slot 68 is formed in the top of the housing 22 through which the member 20 passes in order to engage the output gear 48. The U-shaped slot 68 also facilitates assembly of the drive system 10 although a circular aperture for the threaded member 20 may be alternatively utilized. Thus, as a result of the free-floating properties of the output gear 48 and the slot 68, jamming and backlash are eliminated since the gear teeth of the gears 46 and 48 are provided the freedom to overcome any jamming engagement.

Operation of the present invention provides simple horizon-to-horizon adjustment of the antenna dish 12 with a minimum amount of jamming and misalignment due to backlash. In order to vary the positioning of the antenna 12, the drive means 24 is activated which rotates the extension 50 of the input pinion gear 44. This rotation is translated through the intermediate idler gear 46 to the output pinion gear 48. As the output gear 48 rotates, the threaded engagement between the threaded member 20 and the internal threads 66 of the gear 48 causes the U-shaped member 20 to travel through the housing 22 accordingly. The rotational direction of the output gear 48 will determine the direction of movement of the member 20. As the U-shaped member 20 travels through the housing 22, the directional position of the antenna dish 12 will be varied as it pivots about the support axis 70.

As more communications satellites are placed into orbit, it will become increasingly important for satellite dishes to be capable of receiving signals from anywhere along the arcuate horizon-to-horizon orbit of the satellites. The present invention provides this capability by utilizing a U-shaped threaded member 20 made of sufficient strength and diameter to withstand the weight and pressure exerted by the movement of the antenna dish 12. In the preferred embodiment, the U-shaped member has a diameter of approximately $\frac{7}{8}''$ which resists warping under the weight of the system. Thus, smooth movement over the length of the threaded member 20 can be maintained in order to provide full directional capabilities. In addition, the free-floating output gear 48 also reduces the chance of damage to the threaded member 20 by eliminating jamming and backlash. Such backlash can exert extreme pressure upon the system and particularly the member 20 causing damage thereto and limiting the directional capabilities of the system.

The foregoing detailed description has been given for clearness of understanding only and no unnecessary limitations should be understood therefrom as some modifications will be obvious to those skilled in the art without departing from the scope of the appended claims.

I claim:

1. A satellite antenna drive mechanism for an antenna dish, said drive mechanism comprising:

a substantially U-shaped threaded member secured to a rear face of the antenna dish;

a gear housing having a free-floating internally threaded output pinion gear positionally captured within said gear housing and at least one drive gear drivably connected to said output pinion gear, said threaded member extending through and threadably cooperating with said output pinion gear; and means for driving said gears of said gear housing.

2. The drive mechanism as defined in claim 1 wherein said gear housing includes a pair of spaced wall plates, said gears of said gear housing mounted between said plates.

3. The drive mechanism as defined in claim 2 wherein said at least one drive gear is axially secured to said plates of said gear housing.

4. The drive mechanism as defined in claim 3 wherein said at least one drive gear includes an input pinion gear and an idler gear, said idler gear positioned intermediate and mutually cooperating with said input pinion gear and said output pinion gear.

5. The drive mechanism as defined in claim 4 wherein said input pinion gear is axially connected to said means for driving said gears.

6. The drive mechanism as defined in claim 5 wherein said means for driving said gears comprises drive mechanism for rotatively driving said input pinion gear.

7. The drive mechanism as defined in claim 5 wherein said means for driving said gears comprises a motor drive drivably connected to said input pinion gear.

8. A satellite antenna drive mechanism for antenna dish, said drive mechanism comprising:

a substantially U-shaped threaded member secured to a rear face of said dish;

a gear housing having a pair of spaced wall plates and including a free-floating internally threaded output pinion gear, an intermediate idler gear drivably connected to said output pinion gear and an input pinion gear drivably connected to said intermediate gear, said gears engagingly mounted between said wall plates of said gear housing, said threaded member extending through and threadably cooperating with said output pinion gear;

said output pinion gear positionally captured between said wall plates wherein said output pinion gear floats freely within said gear housing;

said input pinion gear and said idler gear axially secured to said wall plates of said gear housing; and means for driving said gears of said gear housing.

9. The drive mechanism as defined in claim 8 wherein said input pinion gear is axially connected to said means for driving said gears.

10. The drive mechanism as defined in claim 9 wherein said means for driving said gears comprises a manual drive mechanism.

11. The drive mechanism as defined in claim 10 wherein said manual drive mechanism includes a manual drive crank handle for rotatively driving said input pinion gear.

12. The drive mechanism as defined in claim 9 wherein said means for driving said gears comprises a motor drive drivably connected to said input pinion gear.

13. A drive mechanism for reciprocally driving an elongated threaded member, said drive mechanism comprising:

a gear housing having a pair of spaced wall plates and including a free-floating internally threaded output pinion gear, an input pinion gear, and an intermediate idler gear intermeshingly disposed between said wall plates, said threaded member extending through and threadably cooperating with said free-floating output pinion gear;

said output pinion gear positionally captured between said wall plates wherein said output pinion gear floats freely within said housing while remaining meshed with said intermediate idler gear;

said input pinion gear and said idler gear axially secured to said wall plates of said gear housing; and means for rotatively driving said gears of said gear housing.

14. The drive mechanism as defined in claim 13 wherein said input pinion gear is axially connected to said drive means.

15. The drive mechanism as defined in claim 13 wherein said wall plates of said gear housing include a U-shape slot, said threaded member extending through said slot thereby allowing said output pinion gear to float freely between said plates and said threaded member to travel in conjunction with said output gear.

16. The drive mechanism as defined in claim 15 wherein the edges of said slot cooperate with said threaded member to retain aid free-floating output gear within said gear housing.

* * * * *